US005303554A

United States Patent [19]

Faulkner

[11] Patent Number: 5,303,554

[45] Date of Patent: Apr. 19, 1994

[54] LOW NOX INJECTOR WITH CENTRAL AIR SWIRLING AND ANGLED FUEL INLETS

[75] Inventor: Robie L. Faulkner, Alpine, Calif.

[73] Assignee: Solar Turbines Incorporated, San Diego, Calif.

[21] Appl. No.: 983,062

[22] Filed: Nov. 27, 1992

[51] Int. Cl.[5] ..... F02C 7/22

[52] U.S. Cl. ..... 60/737; 60/748

[58] Field of Search ..... 60/737, 740, 742, 748; 239/404, 405, 406

[56] References Cited

U.S. PATENT DOCUMENTS

| | | | |
|---|---|---|---|
| 3,820,320 | 6/1974 | Schirmer et al. | 60/748 |
| 3,980,233 | 10/1976 | Simmons et al. | 60/748 |
| 4,004,875 | 1/1977 | Zink et al. | 431/9 |
| 4,157,890 | 6/1979 | Reed | 431/187 |
| 4,166,834 | 9/1979 | Reed et al. | 422/148 |
| 4,327,547 | 5/1982 | Hughes et al. | 60/742 |
| 4,347,052 | 8/1982 | Reed et al. | 431/188 |
| 4,425,755 | 1/1984 | Hughes | 60/748 |
| 4,483,137 | 11/1984 | Faulkner | 60/39.55 |
| 4,531,904 | 7/1985 | Sato et al. | 431/10 |
| 4,604,048 | 8/1986 | Schwartz et al. | 431/8 |
| 4,925,387 | 5/1990 | Locanetto et al. | 431/187 |
| 5,049,066 | 9/1991 | Kaiya et al. | 431/352 |

*Primary Examiner*—Richard A. Bertsch
*Assistant Examiner*—Timothy S. Thorpe
*Attorney, Agent, or Firm*—Larry G. Cain

[57] ABSTRACT

Past fuel injection nozzles have attempted to provide a structure to reduce exhaust emissions, generally NOx. Such nozzles have failed to attain adequate reduction of exhaust emissions. The present fuel injector structure has resulted in reduced NOx emissions. The structure includes a housing having a central axis and a bore coaxial therewith. An enlarged diameter portion of the housing has a plurality of swirler vanes positioned therein. A frustoconical blending portion is connected between the enlarged diameter portion and the bore. The structure further includes an angled passages intersecting with the bore and being tangent thereto. The unique structure swirls the air and fuel as they meet and mix within the bore. The angular velocity of the air and fuel are additive and provide the fuel injector nozzle with a structure that results in reduced NOx emissions.

18 Claims, 3 Drawing Sheets

LOW NOX INJECTOR WITH CENTRAL AIR SWIRLING AND ANGLED FUEL INLETS

TECHNICAL FIELD

This invention relates generally to gas turbine engines and more particularly to a fuel injection nozzle having a central swirler producing low momentum premixed fuel and air for controlling NOx emissions.

BACKGROUND ART

The use of fossil fuel in gas turbine engines results in the combustion products consisting of carbon monoxide, carbon dioxide, water vapor, particulates, unburned hydrocarbons, nitrogen oxides and sulfur oxides. Of these above products, carbon dioxide and water vapor are considered normal and unobjectionable. In most applications, governmental imposed regulations, are further restricting the remainder of the species mentioned above emitted in the exhaust gases.

In the past, the majority of the products of combustion have bene controlled by design modifications. For example, at the present time particulates in the gas turbine exhaust have been controlled either by design modifications to the combustor and fuel injector or by removing them by traps and filters. Sulfur oxides are normally controlled by the selection of fuels that are low in total sulfur. This leaves carbon monoxide, unburned hydrocarbons and nitrogen oxides as the emissions of primary concern in the exhaust gases being emitted from the gas turbine engine.

Oxides of nitrogen are produced in two ways in conventional combustion systems. For example, oxides of nitrogen are formed at high temperatures within the combustion zone by the direct combination of atmospheric nitrogen and oxygen and by the presence of organic nitrogen in the fuel. The rates with which nitrogen oxides form depends mostly upon the flame temperature and, to some degree upon the concentration of the reactants. Consequently, a small reduction in flame temperature can result in a large reduction in the nitrogen oxides.

Past and some present systems provide gaseous fuel burner systems that include a burner tube and a primary burner head having a plurality of primary burner ports in a two dimensional array, over a selected, substantially planar area, transverse to the burner tube. A mixture of gaseous fuel and primary air is supplied to the burner tube, and to the primary burner ports. Secondary burner ports are provided upstream of the primary burner ports which carry the gaseous fuel and primary air in the form of jets, mixing with the secondary air, and burning to provide combustion products CO2 and H2O, which flow downstreamwardly with the secondary air into the combustion zone of the primary burner. An example of such a system is disclosed in U.S. Pat. No. 4,157,890 issued Jun. 12, 1979, to Robert D. Reed.

Another example of an injector nozzle is disclosed in U.S. Pat. No. 4,483,137 issued Nov. 20, 1984, to Robie L. Faulkner. The patent discloses an injector in which provision is made for introducing a liquid coolant into the combustor of the engine. This reduces the flame temperature in the combustor, thereby discouraging the formation of thermal NOx.

In an attempt to reduce NOx emissions gas, turbine combustion systems have utilized a variety of structurally configured injector nozzles. The above system and injector nozzles used therewith are examples of attempts to reduce the emissions of oxides of nitrogen. The nozzles described above fail to efficiently mix the gaseous fluids with the combustion air to control the emissions of oxides of nitrogen emitted from the combustor.

DISCLOSURE OF THE INVENTION

In one aspect of the invention, a gas turbine engine has a compressor section and a combustor section having an inlet end defining an injector opening and has a fuel injection nozzle positioned therein. The fuel injection nozzle includes a housing having a combustor end, an inlet end, an outer surface, a central axis and a bore coaxial therewith. The bore extends between the combustor end and the inlet end and has an enlarged diameter portion near the inlet end having a plurality of swirler vanes positioned therein. A plurality of swirler vanes are in contact with the outer surface and are positioned in the injector opening. A plenum extends generally from the inlet end toward the combustor end and during operation of an engine has combustible fuel therein. An angled passage communicates between the plenum and the bore. The angled passage extends generally axially from the plenum near the inlet end toward the combustor end and generally radially from the plenum near the inlet end inwardly toward the combustor end, and intersects the bore. The intersection is tangent to the bore.

In another aspect of the invention, a fuel injection nozzle includes a housing having a combustor end, an inlet end, a central axis and a bore coaxial therewith. The bore extends between the combustor end and the inlet end and has an enlarged diameter portion near the inlet end having a plurality of swirler vanes positioned therein. A plenum extends generally from the inlet end toward the combustor end and during operation of an engine has combustible fuel therein. An angled passage communicates between the plenum and the bore. The angled passage extends generally axially from the plenum near the inlet end toward the combustor end and generally radially from the plenum near the inlet end inwardly toward the combustor end, and intersects the bore. The intersection is tangent to the bore.

BEST MODE FOR CARRYING OUT THE INVENTION

Figure 1:
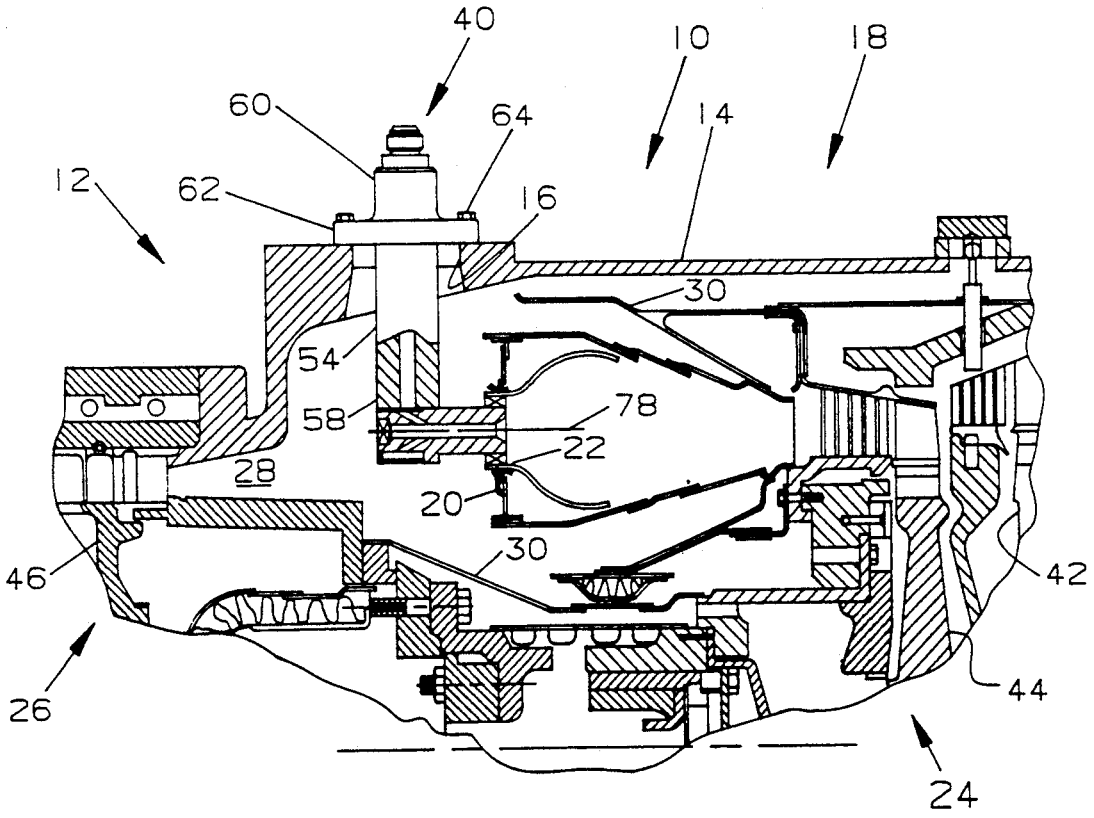
FIG. 1 is a partially sectioned side view of a gas turbine engine having an embodiment of the present invention.

Referring to FIG. 1, a gas turbine engine 10, not shown in its entirety, has been sectioned to show an air delivery system 12 for cooling engine 10 components and providing combustion air. The engine 10 includes an outer case 14 having a plurality of openings 16 therein, of which only one is shown, a combustor section 18 having an inlet end 20 defining an injector opening 22 therein, a turbine section 24, a compressor section 26, and a compressor discharge plenum 28 fluidly connecting the air delivery system 12 to the combustor section 18. The plenum 28 is partially defined by the outer case 14 and a multipiece inner wall 30 partially surrounding the turbine section 24 and the combustor section 18. A plurality of fuel injection nozzles 40 (of which only one is shown) are positioned partially within the plenum 28 and the combustor section 18.

The turbine section 24 includes a power turbine 42 having an output shaft, not shown, connected thereto for driving an accessory component such as a generator. Another portion of the turbine section 24 includes a gas producer turbine 44 connected in driving relationship to the compressor section 26. The compressor section 26, in this application, includes a multistage compressor 46, although only a single stage is shown. When the engine 10 is operating, the compressor 46 causes a flow of compressed air. As an alternative, the compressor section 26 could include a radial compressor or any source for producing compressed air.

Figure 2:
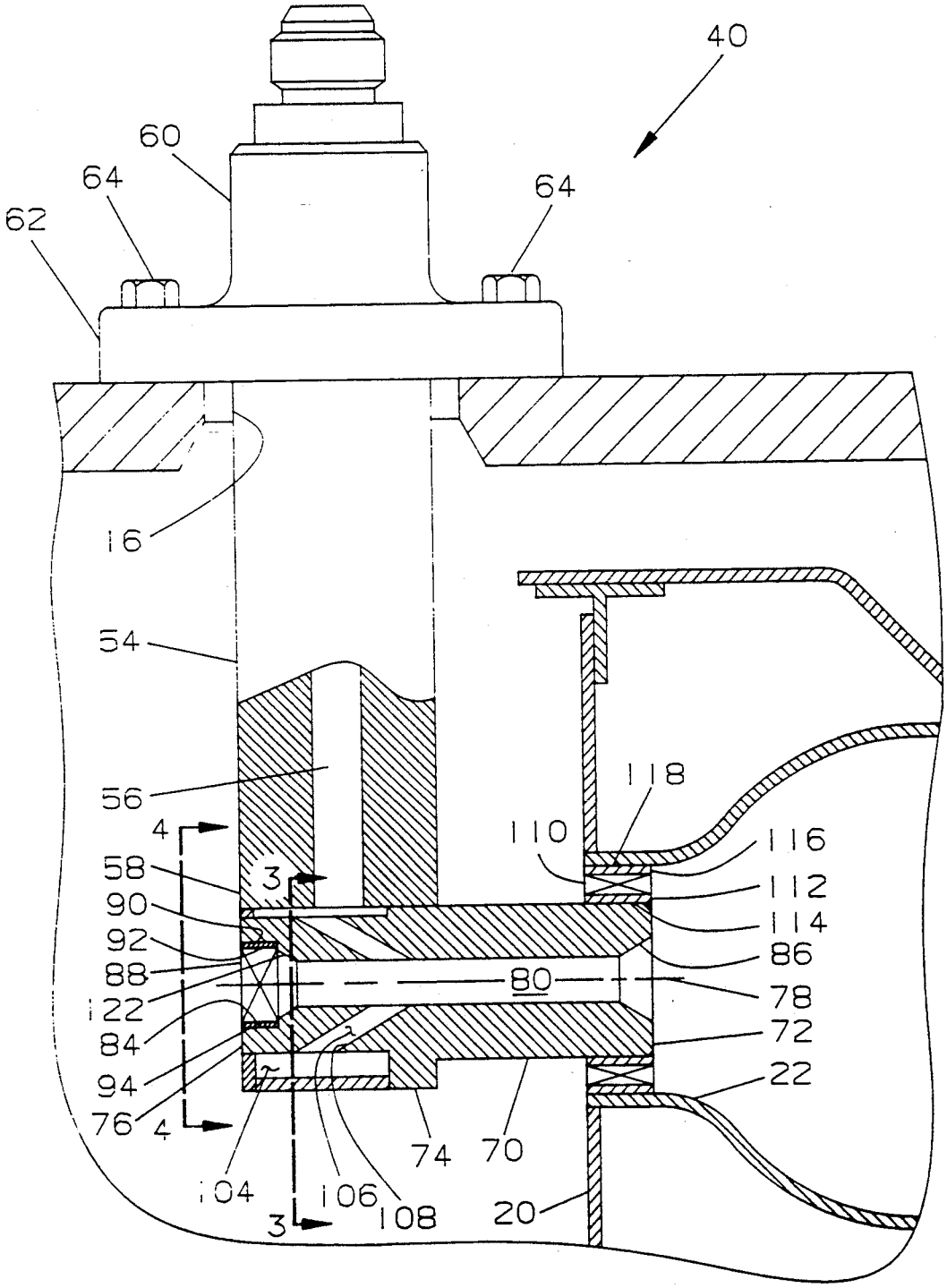
FIG. 2 is an enlarged sectional view of a fuel injection nozzle disclosing one embodiment of the present invention.

In this application and best shown in FIG. 2, each of the fuel injection nozzles 40 is removably attached to the outer case 14 in a conventional manner. The fuel injector nozzle 40 includes an outer tubular member 54 having a passage 56 therein. The outer tubular member 54 includes an outlet end portion 58 and an inlet end portion 60. The outer tubular member 54 extends radially through one of the plurality of openings 16 in the outer case 14 and has a mounting flange 62 extending radially therefrom. The flange 62 has a plurality of holes therein, not shown, in which a plurality of bolts 64 threadedly attach to a plurality of threaded holes, not shown, spaced about each of the plurality of openings 16 in the outer case 14. Thus, the injector 40 is removably attached to the outer case 14. The passage 56 is in fluid communication with a source of fuel not shown.

Figure 3:
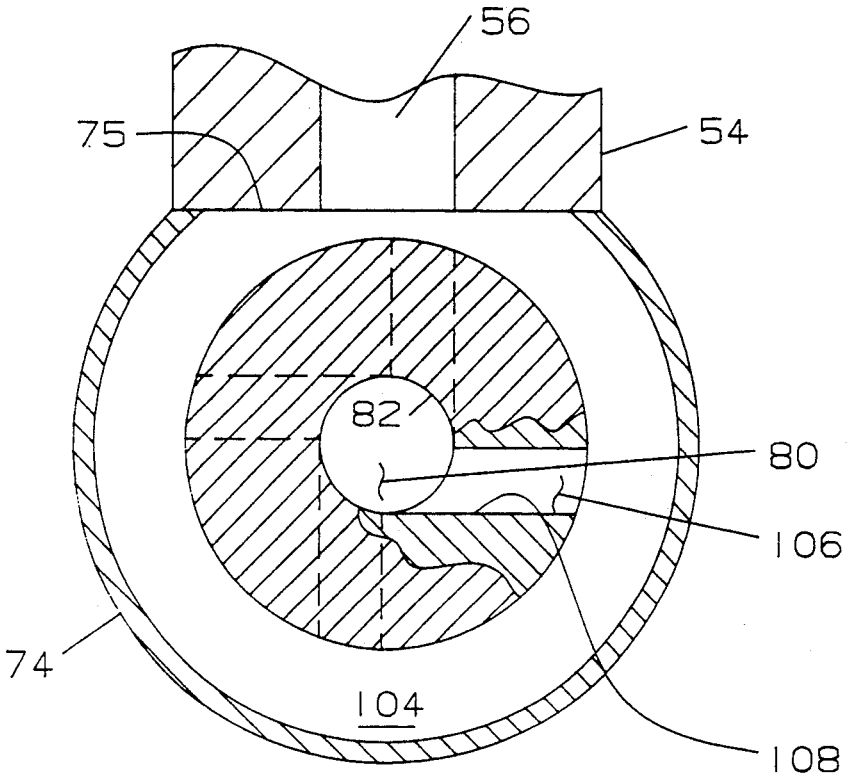
FIG. 3 is an enlarged sectional view taken along line 3—3 of FIG. 2.
Figure 4:
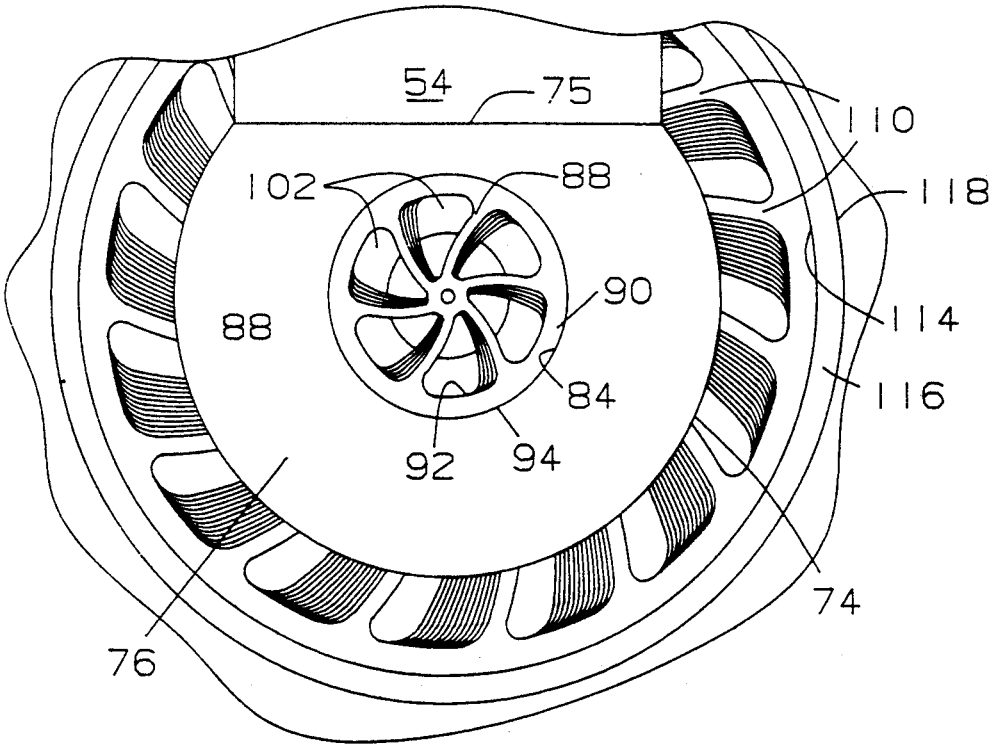
FIG. 4 is an enlarged view taken along line 4—4 of FIG. 2.

As shown in FIGS. 2 and 3, the injector 40 further includes a generally circular housing 70 having a combustor end 72, an outer stepped surface 74 having a flat 75 thereon and a inlet end 76. At the flat 75 the outer surface 74 is attached to the outlet end portion 58 of the outer tubular member 54. The housing 70 further includes a central axis 78 having a bore 80 coaxial therewith extending between the combustor end 72 and the inlet end 76. The bore 80 has an enlarged diameter portion 84 near the inlet end 76 and an outwardly diverging tapered portion 86 at the combustor end 72. As best shown in FIG. 4, a plurality of swirler vanes 88 are positioned in the enlarged diameter portion 84. As an alternative, a radial inflow swirler, not shown, could be positioned externally of the inlet end 76 of the housing 70 and would be aligned with the bore 80. The plurality of swirler vanes 88 have an outer race 90 defining an inner surface 92 and an outer surface 94 in contact with the enlarged diameter portion 84. The plurality of swirler vanes 88 are evenly spaced apart and form preestablished spaces 102 therebetween. A means 103 is provided for supplying fuel to the fuel injection nozzle 40 during operation of the engine 10. The means 103 for supplying fuel includes a plenum 104 extending generally from the inlet end 76 toward the combustor end 72. The plenum 104 is spaced radially inward of the outer surface 74 and radially outward of the bore 80. The plenum 104 is in fluid communication with the passage 56 in the outer tubular member 54. A plurality of angled passages 106 communicate between the plenum 104 and the bore 80. The plurality of angled passages 106 are angled at about 15 degrees to 45 degrees to the central axis 78. In this application, the plurality of angled passages 106 are angled at about 30 degrees to the central axis 78. The plurality of angled passages 106 extend generally axially from the plenum 104 near the inlet end 76 inwardly toward the combustor end 72, generally radially from the plenum 104 near the inlet end 76 inwardly toward the combustor end 72 to intersect the bore 80. The angled passages 106 are also formed to be tangent to the bore 80. Positioned near the combustor end 72 and in contact with the outer surface 74 of the housing 72 is a plurality of swirler vanes 110. The plurality of swirler vanes 110 include and inner race 112 having an inner surface 114 in contact with the outer surface 74. The plurality of swirler vanes 110 further include an outer race 116 having an outer surface 118 positioned in the injector opening 22 of the combustor section 18. The plurality of swirler vanes 110 are evenly spaced between the inner and outer races 112,116 and form a plurality of spaces 120 therebetween.

In this application and best shown in FIGS. 2 and 3, with the plurality of swirler vanes 88 installed in the enlarged diameter portion 84, the contour of the bore 80 includes a frustoconical blending portion 122 extending between the bore 80 and the enlarged diameter portion 84. The blending portion is angled of about 30 degrees with respect to the axis 78. Furthermore, the bore 80 has a diameter of about 7.6 mm and an area of about 45.6 square mm. The plurality of angled passages 106 are four in number, are evenly circumferentially spaced, have an angle of about 30 degrees and are about 3.6 mm in diameter. The tapered portion 86 at the combustor end 72 has a major diameter of about 13.3 mm and tapers inwardly from the major diameter toward the inlet end 76 at an angle of between about 37 and 40 degrees. The total flow area between the swirler vanes 88 is about 1012.7 square mm. The total flow area defined between the swirler vanes is about 22,279.4 square mm. Thus, the ratio of air passing through swirler 110 compared to the air passing through the plurality of swirler vanes 88 and the bore 80 is about twenty-two (22) to one (1).

INDUSTRIAL APPLICABILITY

In use, the gas turbine engine 10 is started in a conventional manner. In this application, the pilot fuel, which is a gaseous fuel, is introduced through the passage 56 into the plenum 104. The gaseous fuel travels through the four angled passages 106 into the bore 80. Combustion air is introduced into the fuel injector 40 through the spaces 102 between the plurality of swirler vanes 88, is caused to swirl and mixes with the gaseous fuel prior to entering the combustor section 18. Additional combustion air is introduced into the combustor section 18 through the plurality of spaces 112 between the plurality of swirler vanes 110 and further mixes with the air and fuel from the bore 80 within the combustor section.

After starting and warm up of the engine 10 has been completed, the fuel rate is varied to control the engine 10 speed depending on the required power output. For example, during initial start up 30 percent to 50 percent of the total fuel required by the engine 10 may be added to start the engine 10. After the engine is warmed up and running, the fuel rate is varied depending on the load. The unique structure of the fuel injector nozzle 40 provides an excellent mixing of the fuel and air, thus, a homogeneous mixture having good burning characteristics resulting in relative low NOx emissions. One important aspect the injector nozzle 40 which provide the mixing include the plurality of swirler vanes 88 positioned in the enlarged bore 84 which cause the air to swirl and create controlled turbulence. As the swirling air exits the plurality of swirler vanes 88 the blending portion 122 gradually necks the flow down into a smaller area in which the velocity is increased and the turbulence is increased. As the flow travels along the passage 80 the fuel is introduce through the angled passages 106. The passages 106 are tangent to the bore 80 such that the fuel entering the bore 80 swirls and swirls in the same direction as the air. The additive swirling vectors establishes uniform mixing characteristics. The angle of the angled passages 106, the swirling of the air within the bore 80 and the tangential action of the fuel allow the velocity and swirling action of the components to be additive and increases the mixing characteristics of the fuel and air. As this homogeneous mixture of fuel and air exits the fuel injector 40 at the combustor end 72, the tapered portion 86 allows the fuel and air mixture to expand reducing the velocity and momentum and intersects with the incoming air which has been caused to swirl in the same direction as the fuel air mixture by the plurality of swirler vanes 110. Thus, mixing of the fuel and air mixture and additional air further insures a good combustible mixture having burning characteristics which produce reduced NOx emissions.

The present fuel injector 40 structure has resulted in an injector having reduced NOx emissions injector. The position of the plurality of vanes 88, the blending portion 122, the tapered portion 86 and the angled passages 106 tangentially intersecting with the bore 80 and the angle of the angled passages 106 have created this unique structure. Thus, the use of the above described fuel injector nozzle 40 has resulted in reduced NOx emissions.

Other aspects, objects and advantages will become apparent from a study of the specification, drawings and appended claims.

I claim:

1. A fuel injection nozzle comprising:

a housing having an outlet end, an inlet end positioned at an end opposite the outlet end, a central axis and a central bore, said bore extending between the outlet end and the inlet end and having an enlarged diameter portion near the inlet end;

a plurality of swirler vanes being positioned within the enlarged diameter portion and substantially filling the enlarged diameter portion;

an angled passage being positioned in the housing communicating with the bore;

a frustoconical blending portion extending between the bore and the enlarged diameter portion;

a means for supplying fuel to the fuel injection nozzle during operation of an engine, said means for supplying fuel including a plenum coaxially positioned about the bore and being near the inlet end; and said angled passage extending generally axially from the plenum near the inlet end toward the outlet end and generally radially from the plenum near the inlet end inwardly toward the outlet end and intersecting the bore, said intersection being tangent to the bore.

2. The fuel injection nozzle of claim 1 wherein said frustoconical blending portion has an included angle of about 60 degrees.

3. The fuel injection nozzle of claim 1 wherein said angled passage includes a plurality of angled passages.

4. The fuel injection nozzle of claim 3 wherein said plurality of angled passages includes four evenly spaced angled passages.

5. The fuel injection nozzle of claim 1 wherein said bore includes a tapered portion at the combustor end.

6. The fuel injection nozzle of claim 5 wherein said tapered portion has a major diameter and said taper is inwardly from the major diameter toward the inlet end at an angle of between 37 degrees and 40 degrees to the central axis.

7. The fuel injection nozzle of claim 1 wherein said housing further including an outer surface having a plurality of swirler vanes in contact with the outer surface and wherein said bore has a preestablished flow area and said plurality of swirler vanes in contact with the outer surface has a preestablished flow area larger than said preestablished flow area of the bore.

8. The fuel injection nozzle of claim 7 wherein said larger preestablished flow area is about 20 to 25 times larger than the preestablished flow area of the bore.

9. The fuel injection nozzle of claim 7 wherein said larger preestablished flow area is about 22 times larger than the preestablished flow area of the bore.

10. A gas turbine engine having a compressor section and a combustor section having an inlet end defining an injector opening and having a fuel injection nozzle positioned therein, said fuel injection nozzle comprising:

a housing having an outlet end, an inlet end positioned at an end opposite the outlet end, an outer surface, a central axis and a central bore, said bore extending between the outlet end and the inlet end and having an enlarged diameter portion near the inlet end;

a plurality of swirler vanes positioned within the enlarged diameter portion and substantially filling the enlarged diameter portion;

a plurality of swirler vanes in contact with the outer surface and being positioned in the injection opening;

an angled passage positioned in the housing and communicating with the bore;

a frustoconical blending portion extending between the bore and the enlarged diameter portion;

a means for supplying fuel to the fuel injection nozzle during operation of an engine, said means for supplying fuel including a plenum coaxially positioned about the bore and being near the inlet end; and said angled passage extending generally axially from the plenum near the inlet end toward the outlet end and generally radially from the plenum near the inlet end inwardly toward the outlet end and intersecting the bore, said intersection being tangent to the bore.

11. The fuel injection nozzle of claim 10 wherein said frustoconical blending portion has an included angle of about 60 degrees.

12. The fuel injection nozzle of claim 10 wherein said angled passage includes a plurality of angled passages.

13. The gas turbine engine of claim 12 wherein said plurality of angled passages includes four evenly spaced angled passages.

14. The gas turbine engine of claim 10 wherein said bore includes a tapered portion at the combustor end.

15. The gas turbine engine of claim 14 wherein said tapered portion has a major diameter and said taper is inwardly from the major diameter toward the inlet end at an angle of between 37 and 40 degrees to the central axis.

16. The gas turbine engine of claim 10 wherein said bore has a preestablished flow area and said injector opening after having the swirler and the injection nozzle positioned therein has a preestablished flow area being larger than the preestablished flow area of the bore.

17. The gas turbine engine of claim 16 wherein said larger preestablished flow area is about 20 to 25 times larger than the preestablished flow area of the bore.

18. The gas turbine engine of claim 10 wherein said larger preestablished flow area is about 22 times larger than the preestablished flow area of the bore.

* * * * *

UNITED STATES PATENT AND TRADEMARK OFFICE

CERTIFICATE OF CORRECTION

PATENT NO. : 5,303,554

DATED : April 19, 1994

INVENTOR(S) : Robie L. Faulkner

It is certified that error appears in the above-identified patent and that said Letters Patent is hereby corrected as shown below:

Claim 11, column 6, line 56, "fuel injection nozzle" should be "gas turbine engine".

Claim 12, column 6, line 59, "fuel injection nozzle" should be "gas turbine engine".

Signed and Sealed this

Thirteenth Day of September, 1994

*Attest:*

Bruce Lehman

BRUCE LEHMAN

*Attesting Officer*

*Commissioner of Patents and Trademarks*